US008363868B2

(12) United States Patent
Fusakawa et al.

(10) Patent No.: US 8,363,868 B2
(45) Date of Patent: Jan. 29, 2013

(54) HEARING AID, HEARING-AID APPARATUS, HEARING-AID METHOD AND INTEGRATED CIRCUIT THEREOF

(75) Inventors: Kazue Fusakawa, Kanagawa (JP); Megumi Yokokura, Kanagawa (JP); Yoshiaki Takagi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 499 days.

(21) Appl. No.: 12/663,761

(22) PCT Filed: Apr. 7, 2009

(86) PCT No.: PCT/JP2009/001600

§ 371 (c)(1),
(2), (4) Date: Dec. 9, 2009

(87) PCT Pub. No.: WO2009/125579

PCT Pub. Date: Oct. 15, 2009

(65) Prior Publication Data

US 2010/0254554 A1 Oct. 7, 2010

(30) Foreign Application Priority Data

Apr. 9, 2008 (JP) ..... 2008-101190

(51) Int. Cl.
*H04R 25/00* (2006.01)

(52) U.S. Cl. ..... 381/315; 381/60; 381/314; 340/539.12

(58) Field of Classification Search ..... 381/315, 381/60, 314; 340/571, 539.1–539.12
See application file for complete search history.

(56) References Cited

U.S. PATENT DOCUMENTS 5,721,783 A 2/1998 Anderson
6,297,737 B1 * 10/2001 Irvin ..... 340/571
(Continued)

FOREIGN PATENT DOCUMENTS

EP 1 629 801 3/2006
JP 11-511301 9/1999
(Continued)

OTHER PUBLICATIONS

International Search Report issued May 19, 2009 in corresponding International Application No. PCT/JP2009/001600.

(Continued)

*Primary Examiner* — Curtis Kuntz
*Assistant Examiner* — Amir Etesam
(74) *Attorney, Agent, or Firm* — Wenderoth, Lind & Ponack, L.L.P.

(57) ABSTRACT

A hearing aid (100) fits in an ear of a user and amplifies a sound and outputs the amplified sound. Specifically, the hearing aid includes: a microphone (110) as a pick-up unit which picks up the sound; a wireless communicating unit (130) which receives, from an external apparatus connected via wireless, an instruction for outputting a searching sound, the instruction for outputting a searching sound which is used for outputting a searching sound; an amplifier (140) which amplifies the outputted sound; an earphone (150) as an outputting unit which outputs the sound amplified by the amplifier (140); and an operation switching unit (120) which switches between a hearing mode and a searched mode, the hearing mode causing the amplifier (140) to amplify a hearing sound which is a sound picked up by the microphone (110) with a use of a first amplification factor, and the searched mode causing the amplifier (140) to amplify the searching sound, in response to the reception of the instruction for outputting a searching sound, with a use of a second amplification factor greater than the first amplification factor.

12 Claims, 7 Drawing Sheets

U.S. PATENT DOCUMENTS

| | | | | |
|---|---|---|---|---|
| 7,889,879 | B2 * | 2/2011 | Dillon et al. | 381/314 |
| 2004/0196985 | A1 | 10/2004 | Kokubo | |
| 2005/0168338 | A1 | 8/2005 | Parker et al. | |
| 2006/0002335 | A1 | 1/2006 | Itoh et al. | |
| 2007/0117510 | A1 | 5/2007 | Elixmann | |

FOREIGN PATENT DOCUMENTS

| | | | |
|---|---|---|---|
| JP | 2001-145198 | * | 5/2001 |
| JP | 2001-238296 | | 8/2001 |
| JP | 3521384 | | 2/2004 |
| JP | 2004-172728 | | 6/2004 |
| JP | 3655149 | | 3/2005 |
| JP | 2006-20002 | | 1/2006 |
| JP | 2007-124022 | | 5/2007 |
| JP | 2007-521733 | | 8/2007 |
| WO | 96/41498 | | 12/1996 |
| WO | 98/09265 | | 3/1998 |
| WO | 2004/091251 | | 10/2004 |
| WO | 2005/004415 | | 1/2005 |

OTHER PUBLICATIONS

Extended European Search Report (in English language) issued Sep. 24, 2012 in corresponding European patent application No. 09 729 238.7.

* cited by examiner

HEARING AID, HEARING-AID APPARATUS, HEARING-AID METHOD AND INTEGRATED CIRCUIT THEREOF

TECHNICAL FIELD

The present invention relates to a hearing aid to be easily found in the case where the hearing aid is misplaced.

BACKGROUND ART

Most of hearing-impaired people have chosen an in-the-canal hearing aid thanks to its inconspicuousness. Such a hearing aid includes: a body into which an electric circuit, such as a microphone, and a battery are built; an extending portion, having a speaker pore, into an external auditory canal; and a cover for covering the battery. An overall appearance of the hearing aid is designed in a shape and dimensions that allow the hearing aid itself to be inserted into the ear hole (See Patent Reference 1, for example).

Another hearing aid is equipped with a strap, so that the user may avoid misplacing and inadvertently dropping the hearing aid Meanwhile, minor hearing-impaired people do not have to wear a hearing aid all day in the above manner. Thus, when the minor hearing-impaired people use an in-the-canal hearing aid, those people put on and take off the hearing aid more often than the regular impaired people do.

CITATION LIST

[Patent Literature]

Patent Reference 1: Japanese Unexamined Patent Application Publication No. 2001-238296

Patent Reference 2: Japanese Unexamined Patent Application Publication No. 2007-124022

SUMMARY OF INVENTION

Technical Problem

Downsizing a conventional in-the-canal hearing aid has caused a problem; that is, it is troublesome, in particular for the elderly, to find a hearing aid once it is misplaced.

The present invention is conceived in view of the above problem and has as an object to provide a hearing aid to be easily found in the case where the hearing aid is misplaced.

Solution to Problem

A first aspect of a hearing aid in accordance with the present invention fits in an ear of a user, and amplifies a sound and outputs the amplified sound. Specifically, the hearing aid includes: a pick-up unit which picks up the sound; a wireless communicating unit which receives, from an external apparatus connected via wireless, an instruction for outputting a searching sound, the instruction for outputting a searching sound being used for outputting a searching sound; an amplifying unit which amplifies the sound; an outputting unit which outputs the sound amplified by the amplifying unit; and an operation switching unit which switches between a hearing mode and a searched mode, the hearing mode causing the amplifying unit to amplify a hearing sound which is a sound picked up by the pick-up unit with a use of a first amplification factor, and the searched mode causing the amplifying unit to amplify the searching sound, in response to the reception of the instruction for outputting a searching sound, with a use of a second amplification factor greater than the first amplification factor.

Since the above structure allows the searching sound to be amplified with a use of an amplification factor (second amplification factor) greater than a regular amplification factor, the user can easily locate the hearing aid when the hearing aid is misplaced. It is noted that the "sound" includes the hearing sound and the searching sound. Further, the "external apparatus", which is not particularly limited, includes for example another hearing aid of the pair of binaural hearing aids, and a remote control which controls the pair of binaural hearing aids. Moreover, the "sound" is not limited to a voice produced by a person. The "sound" is a concept (sound) including music.

The hearing aid further includes a storing unit which stores a parameter indicating a frequency band suitable for remaining hearing of the user, wherein, in the searched mode, the amplifying unit may selectively amplify the frequency band indicated by the parameter with a use of the second amplification factor, the frequency band being included in the searching sound.

A typical hearing aid user has a problem with his or her ear. Hence, a simply provided searching sound may not be audible to the user. Thus, by processing a signal of a searching sound based on the remaining hearing of the user to provide the searching signal, the user can locate the misplaced hearing aid more easily.

As a modification, the hearing aid further includes a storing unit which stores the searching sound, wherein the amplifying unit may amplify the searching sound read from the storing unit with a use of the second amplification factor when the wireless communicating unit receives the instruction for outputting a searching sound.

As another modification, the wireless communicating unit further receives the searching sound from the external apparatus, and the amplifying unit may amplify the searching sound with a use of the second amplification factor when the wireless communicating unit receives the searching sound.

The hearing aid may further include a providing delay unit, in the searched mode, which delays the searching sound for a predetermined delay time, and provides the delayed searching sound to the outputting unit, the searching sound being amplified by the amplifying unit with a use of the second amplification factor. This prevents the sound which the user has produced at the external apparatus and the sound outputted from the misplaced hearing aid from overlapping.

The predetermined delay time may be between 0.2 seconds and 5 seconds. A continuing length of a vowel sound; that is possibly a minimum lasting time period of one syllabic sound, lasts 0.2 seconds. Thus the delay time is desirably as long as 0.2 seconds or longer. Meanwhile, too long a delay time may cause the user to misunderstand that the misplaced hearing aid is out of his or her hearing range. Thus, the delay time is desirably set within the above delay time.

Further, the operation switching unit may further select the searching mode causing the wireless communicating unit to transmit the instruction for outputting a searching sound to an other hearing aid. In addition, in the searching mode, the operation switching unit may cause the wireless communicating unit to transmit, as the searching sound, the sound picked up by the pick-up unit to the other hearing aid. When the user misplaces one of the hearing aids of the pair of binaural hearing aids, the operation switching unit allows the user to conduct a search with a use of the pick-up unit and the wireless communicating unit included in another one of the pair of the hearing aids.

An aspect of a hearing aid apparatus in accordance with the present invention includes: a first hearing aid which fits in an ear of a user and is a hearing aid described above; and a second hearing aid which fits in an other ear of the user and is a hearing aid described above.

Specifically, the wireless communicating unit of each of the first hearing aid and the second hearing aid may: mutually hold wireless communication with a use of a first communicating mode in the case where both of the first hearing aid and the second hearing aid are in a hearing mode; and mutually hold wireless communication with a use of a second communicating mode in the case where the first hearing aid and the second hearing aid are in the searching mode and the searched mode, respectively, the second communicating mode being wider than the first communicating mode in communication area.

The pair of binaural hearing aids always holds wireless communication between the hearing aids in order to synchronize setting values of the hearing aids each other, and monitor each other whether or not the other hearing aid is normally operating. Here, when a pair of hearing aids operates in the "hearing mode", the communication may be maintained at a distance between both of the ears of the user. Thus, the communication is held in the first communicating mode of which communication range is narrow and power consumption is low. Meanwhile, when the user misplaces both of the pair of binaural hearing aids, a priority is given to locating the misplaced pair of binaural hearing aids rather than to power consumption. Thus, the communication is held in the second communicating mode of which communication range is wide and power consumption is high.

Further, the hearing aid apparatus may further include a remote control which transmits via wireless an instruction for outputting a searching sound to at least one of the first hearing aid and the second hearing aid. Usually, the remote control is used for synchronizing setting values between the first and the second hearing aids. Thus, by outputting the instruction for outputting a searching sound from the remote control, the user can easily locate the pair of binaural hearing aids when both of the hearing aids are misplaced.

An aspect of a hearing aid method in accordance with the present invention is a method for amplifying a sound and providing the amplified sound, using a hearing aid fitting in an ear of a user. Specifically, the method includes: picking up the sound; receiving an instruction for providing a searching sound from an external apparatus connected via wireless, the instruction for providing a searching sound being used for providing a searching sound; amplifying the sound; providing the sound amplified in the amplifying; and in the amplifying, switching between a hearing mode and a searched mode, the hearing mode involving amplifying a hearing sound which is a sound picked up in the picking up with a use of a first amplification factor, and the searched mode involving amplifying the searching sound, in response to the reception of the instruction for providing a searching sound, with a use of a second amplification factor greater than the first amplification factor.

An aspect of an integrated circuit in accordance with the present invention amplifies a sound and outputs the amplified sound. Specifically, the integrated circuit includes: a pick-up unit which picks up the sound; a wireless communicating unit which receives, from an external apparatus connected via wireless, an instruction for outputting a searching sound, the instruction for outputting a searching sound being used for outputting a searching sound; an amplifying unit which amplifies the sound; an outputting unit which outputs the sound amplified by the amplifying unit; and an operation switching unit which switches between a hearing mode and a searched mode, the hearing mode causing the amplifying unit to amplify a hearing sound which is a sound picked up by the pick-up unit with a use of first amplification factor, and the searched mode causing the amplifying unit to amplify the searching sound, in response to the reception of the instruction for outputting a searching sound, with a use of a second amplification factor greater than the first amplification factor.

It is noted that the present invention can be realized as an integrated circuit to achieve a function of the hearing aid, and a program causing a computer to execute such a function, as well as realized as the hearing aid. As a matter of course, such a program can be distributed via a recording medium including a CD-ROM and a transmission medium including the Internet.

Advantageous Effects of Invention

A hearing aid of the present invention can produce a sound as necessary from the hearing aid which the user is looking for in order to help the user locate the hearing aid.

DESCRIPTION OF EMBODIMENTS

Described hereinafter are embodiments of the present invention, with reference to the drawings.

Embodiment 1

Figure 1A:
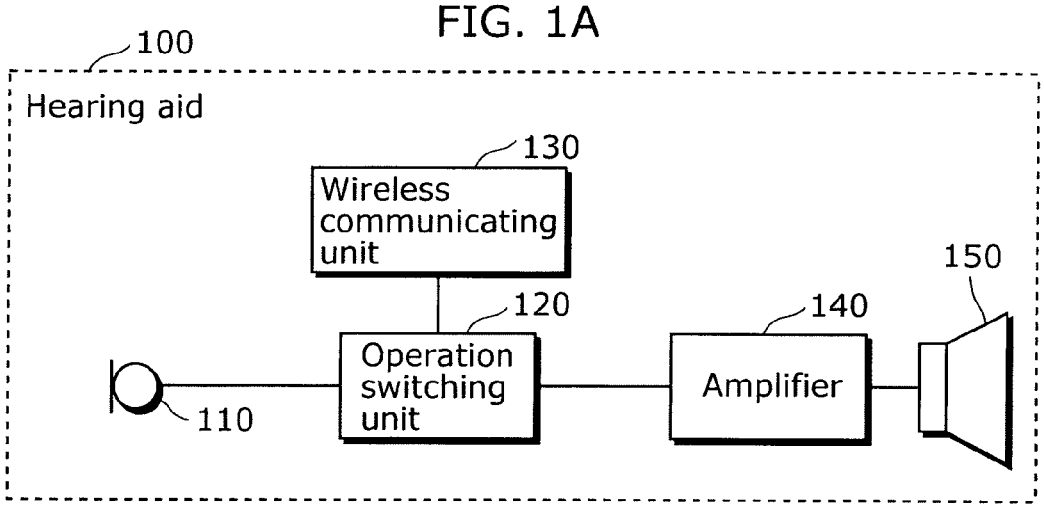
FIG. 1A is a functional block diagram of a hearing aid in accordance with an embodiment 1 of the present invention.

Described herewith is a hearing aid in accordance with an embodiment 1 of the present invention with reference to FIGS. 1A to 1C, and FIG. 2. It is noted that FIG. 1A is a block diagram showing a structure of a hearing aid 100.

The hearing aid 100 in accordance with the embodiment 1 of the present invention includes a microphone 110 used for a sound pick-up unit, an operation switching unit 120, a wireless communicating unit 130, an amplifier (an amplifying unit) 140, and an earphone 150 used for an output unit. Typically, a pair of the hearing aids 100 having an identical structure is used as a pair of binaural hearing aids (hearing-aid apparatus).

The microphone 110 picks up a sound around the hearing aid 100. The operation switching unit 120 switches among operation modes of the hearing aid 100. Specifically, the operation switching unit 120 mutually switches among a hearing mode, a searching mode, and a searched mode. The wireless communicating unit 130 transmits and receives a signal to and from an external apparatus. The amplifier 140 amplifies a received sound. The earphone 150 outputs the sound amplified by the amplifier 140.

The wireless communicating unit 130 typically (i) transmits and receives setting information between the pair of hearing aids 100 to synchronize setting values of the hearing aids each other, and (ii) maintains communication for a predetermined time period (10 seconds, for example) so that the pair of hearing aids 100 makes sure each other whether or not the other hearing aid 100 is normally operating. As described hereinafter, the wireless communicating unit 130 gives an instruction for outputting a searching sound and performs transmission and reception of the searching sound. It is noted that wireless communication is not specifically limited to a particular kind, and thus electromagnetic induction, infrared, and Bluetooth may be employed.

The amplifier 140 amplifies the sound obtained from the operation switching unit 120 and outputs the obtained sound to the earphone 150. It is noted that the amplifier 140 in accordance with the embodiment 1 can adjust an amplification factor according to the mode of the hearing aid 100. The structure of amplifier 140 is not specifically limited to a particular structure. The amplifier 140 may be an amplifier which can freely change the amplification factor. Plural amplifiers each having a different amplification factor may also be included in the structure, so that the operation switching unit 120 may select which amplifier to be used based on the operation mode.

Figure 1B:
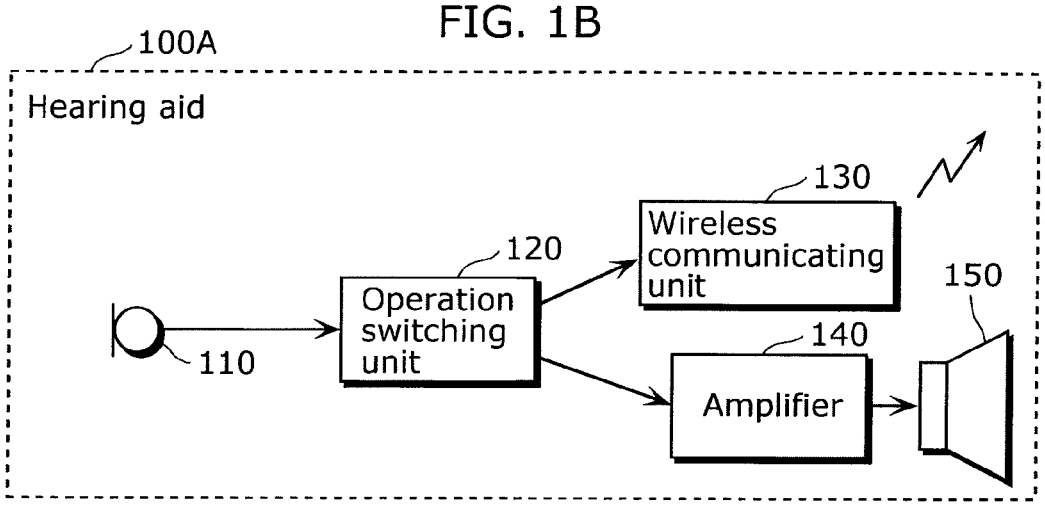
FIG. 1B shows a data flow when the hearing aid in accordance with the embodiment 1 operates in a "hearing mode" and in a "searching mode".
Figure 1C:
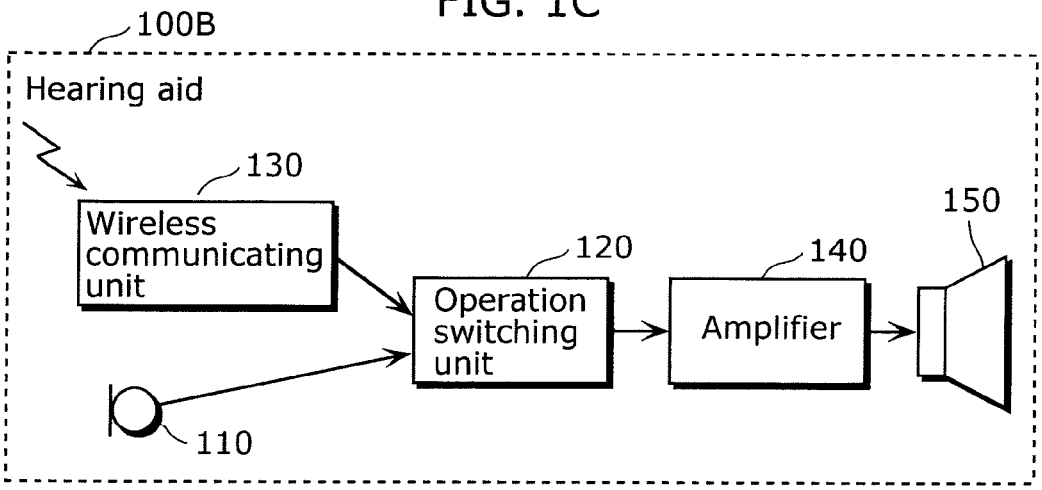
FIG. 1C shows a data flow when the hearing aid in accordance with the embodiment 1 operates in the "hearing mode" and in a "searched mode".
Figure 2:
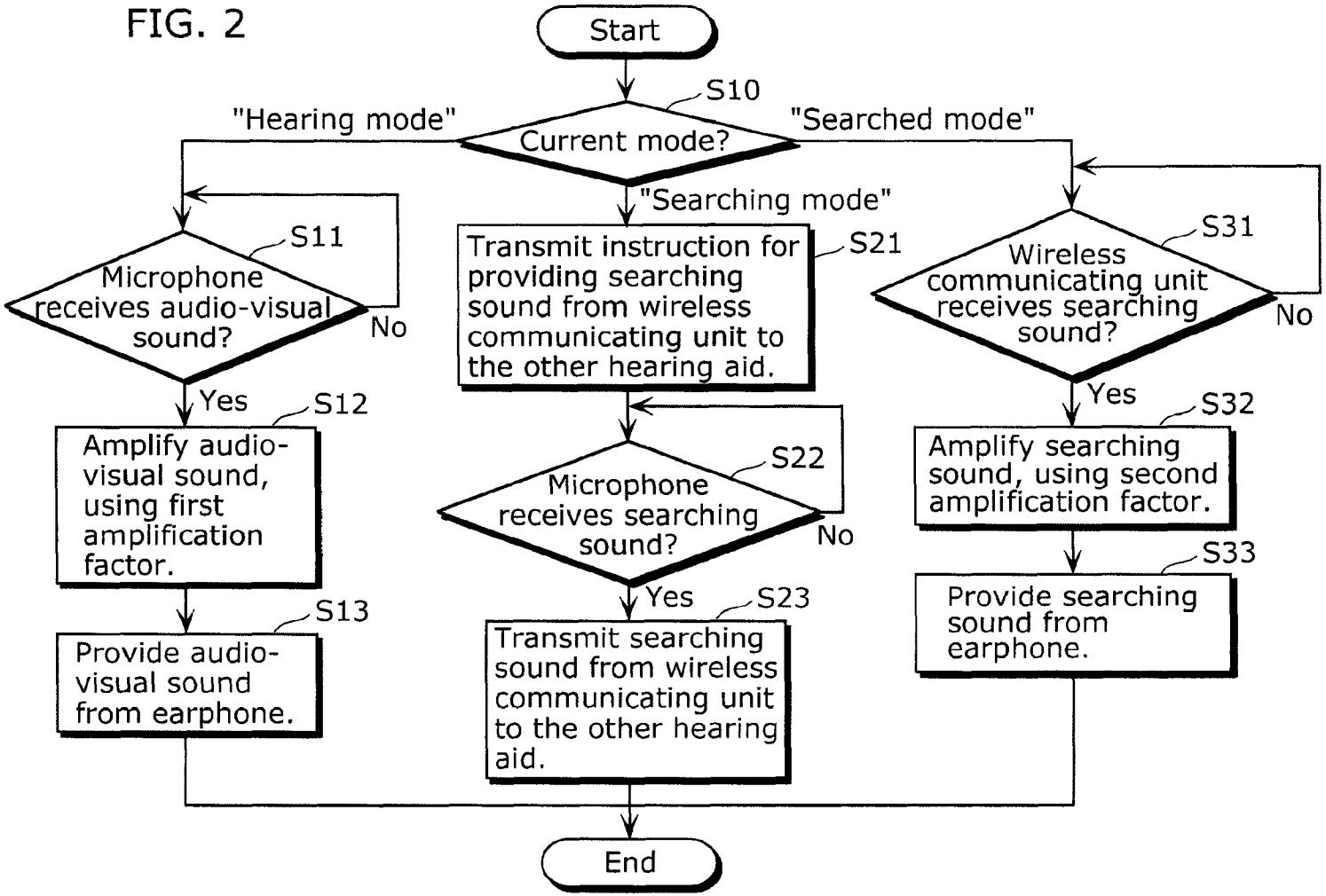
FIG. 2 is a flow chart showing an operation of the hearing aid in accordance with the embodiment 1.

It is noted that arrows in FIG. 1B show flows of a signal when a hearing aid 100A operates in the "hearing mode" and the "searching mode". Meanwhile, arrows in FIG. 1C show flows of a signal when a hearing aid 100B operates in the "hearing mode" and the "searched mode". Further, FIG. 2 is a flow chart showing operations of the hearing aids 100A and 100B in each of operation modes.

When the hearing aid 100A operates in the "hearing mode" (S10: "hearing mode"), the operation switching unit 120 monitors the microphone 110 receiving a hearing sound (S11). Upon detecting the microphone 110 receiving the hearing sound (S11: Yes), the operation switching unit 120 controls the amplifier 140, and causes the amplifier 140 to amplify, using a first amplification factor, the hearing sound picked up by the microphone 110 (S12). Then, the amplified hearing sound is outputted from the earphone 150 (S13).

It is noted that the first amplification factor amplifies the hearing sound outputted from the earphone 150 to the degree that a user wearing the hearing aid 100 can clearly hear the hearing sound. The case where the hearing aid 100B operates in the "hearing mode" is similar to the above, and thus details of the operation shall be omitted.

When the hearing aid 100 operates in the "searching mode" (S10: "searching mode"), the operation switching unit 120 controls the wireless communicating unit 130, and causes the wireless communicating unit 130 to transmit to the hearing aid 100B the instruction for providing a searching sound (S21). Next, the operation switching unit 120 monitors the microphone 110 receiving the searching sound (S22). Upon detecting the microphone 110 receiving the searching sound (S22: Yes), the operation switching unit 120 controls the wireless communicating unit 130, and causes the wireless communicating unit 130 to transmit to the hearing aid 100B the searching sound picked up by the microphone 110 (S23).

Further, when the hearing aid 100B operates in the "searched mode" (S10: "searched mode"), the operation switching unit 120 monitors the wireless communicating unit 130 receiving the searching sound (S31). Upon detecting the wireless communicating unit 130 receiving the searching sound (S31: Yes), the operation switching unit 120 controls the amplifier 140, and causes the amplifier 140 to amplify, using a second amplification factor, the searching sound received by the wireless communicating unit 130 (S32). Then, the amplified searching sound is outputted from the earphone 150 (S33).

It is noted that the second amplification factor amplifies the searching sound outputted from the earphone 150 to the degree that the user can hear the searching sound as far as several meters (several tens of meters in quiet surroundings) away from the hearing aid 100. In other words, the second amplification factor is greater than the first amplification factor.

There are several advantages of wearing the hearing aids 100 on both ears. One of the advantages, for example, is improvement in perceptibility of direction of a sound source and hearing; that is, the user can: hear when he or she is spoken from either right or left; see improvement in hearing in noisy surroundings; and recognize the arrival direction of a sound. Further, compared with hearing a sound with one ear, hearing with both ears sees improvement in sensitivity of an auditory sense thanks to the binaural summation effect. As a result, reproduced sound pressure can be set lower in hearing with both ears than in hearing with one ear, which reduces the stress on the ears. Due to the above advantages, more and more users are expected to use binaural hearing aids. Meanwhile, increasing are the number of hearing-impaired people who prefer an extremely-compact Completely In the Canal (CIC) hearing aid which fits entirely within the user's ear canal and a small open-fitting hearing aid giving no plugged up feeling. This will encourage improvements of the hearing aids in appearance, taking inconspicuousness and comfort into consideration.

As a disadvantage of a small hearing aid giving little discomfort in wearing, however, the hearing aid can inadvertently fall out, which the user can not notice. In the end, the user may not know where the hearing aid has gone. In particular, the minor hearing-impaired people can handle their daily lives without wearing a hearing aid all day long, and that is why they may misplace their hearing aids while occasionally putting on and taking off their hearing aids. The majority of the hearing aid users; namely the elderly, has most likely developed diminished visual acuity. Thus, it is highly difficult for them to find a small hearing aid once they misplace it. Further, there are many cases of lost hearing aids at a gathering place for many elderly people, such as a meeting place accommodating a lot of people. Some elderly people have taken different hearing aids to their misplaced hearing aids, and kept the wrong ones. Thus, requested has been improvement in locating a misplaced hearing aid.

A user using a pair of binaural hearing aids may misplace only one hearing aid or both of the hearing aids. Described in the embodiment 1 is an improved measure employed in the case where the hearing aid 100B; namely one of the pair of the binaural hearing aids, is misplaced.

Described herewith is an effective searching measure in the case where one of the pair of binaural hearing aids is misplaced; namely either the hearing aid 100A or 100B, with reference to FIGS. 1B, 1C, and FIG. 2. It is noted that the hearing aid 100A in FIG. 1B is assumed to be left at the user, and the hearing aid 100B in FIG. 1C misplaced.

In the embodiment 1, the user searches for the hearing aid 100B by speaking to the microphone 110 in the hearing aid 100A left at the user, so that the user's sound is amplified on the hearing aid 100B. Here, the hearing aid 100A works as a transmitter for transmitting the sound, and the hearing aid 100B as a receiver for receiving the sound transmitted from the hearing aid 100A and outputting the searching sound. The hearing aid 100B uses a built-in hearing speaker (the earphone 150) to output information on the sound of the searcher.

The hearing aid 100A operating in the "searching mode" causes the wireless communicating unit 130 (working as a wireless transmitting unit) to transmit the searching sound to the hearing aid 100B. Here, the searching sound is outputted by the searcher to the microphone 110. Meanwhile, the hearing aid 100B operating in the "searched mode" causes the wireless communicating unit 130 (working as a wireless receiving unit) to receive the searching sound transmitted from the hearing aid 100A. Then, the hearing aid 100B operating in the "searched mode" outputs the searching sound to the searcher via the earphone 150. Here, the searching sound is amplified by the amplifier 140, using the second amplification factor. Hence with a help of the searching sound emitted from the hearing aid 100B, the searcher can find the hearing aid 100B which is small and thus difficult to visually locate.

It is noted that the operation modes can be manually switched via a mode selector switch (not shown) on the hearing aid 100. Here, switching the "searched mode" from another operation mode is to be triggered by reception of the instruction for outputting a searching sound.

The pair of binaural hearing aids in accordance with the embodiment 1 may be equipped with a remote control (not shown). The remote control can set setting information on volume, for example, via synchronizing both of the hearing aids 100A and 100B for the right and the left ears. Further, the remote control may include a microphone (not shown) for picking up the searching sound and a wireless communicating unit (not shown) for transmitting the instruction for outputting a searching sound and the searching sound to the hearing aids 100A and 100B.

This is especially effective when the user misplaces both of the hearing aid 100A and 100B since the instruction for outputting a searching sound and the searching sound can be transmitted via the remote control, and the searching sound can be outputted from the hearing aid 100A and 100B. When the instruction for outputting a searching sound and the searching sound are transmitted via the remote control, the "searching mode" of the hearing aid 100 can be omitted.

According to the above structure, the user talks to the microphone 110 in the hearing aid 100 left at the user or to the remote control when the user has misplaced one of the pair of binaural hearing aids, so that the sound of the user is outputted from the misplaced hearing aid 100B. With a help of the sound, the user can easily locate the misplaced hearing aid 100B. Since the sound is outputted from the earphone (speaker) 150, the information of the person who misplaced the misplaced hearing aid 100B can be given to the people nearby by the misplaced hearing aid 100B saying "This hearing aid belongs to X". Moreover, this structure eliminates the need for having an extra memory for accumulating the sound source, which leads to the reduction of the capacity of memory.

It is noted that the "searching mode" and the "searched mode" are described as separate operation modes in the above embodiment 1; meanwhile, the searching mode and the searched mode may be combined as one operation mode (a "non-hearing mode" for example). In other words, the hearing aid 100 operating in the non-hearing mode (i) transmits the sound picked up by the microphone 110 from the wireless communicating unit 130 (the operation in the searching mode), (ii) amplifies the sound received by the wireless communicating unit 130 on the amplifier 140, using the second amplification factor, and (iii) outputs the amplified sound from the earphone 150 (the operation in the searched mode).

In addition, for a visually impaired user, the hearing aid 100 may automatically switch the operation mode to the non-hearing mode when the hearing aid 100 detects being misplaced itself. A measure for detecting the misplaced hearing aid 100 in automatically switching the operation mode may involve the hearing aid 100A and 100B (i) monitoring their communication states each other, and (ii) both automatically switching from the "hearing mode" to the "non-hearing mode" either when a communication delay is confirmed to be as long as a predetermined time or longer, or the number of timeouts reaches to certain times or more. In order to detect another timing for switching the mode, available measures includes: detecting the case where the sound environments of the hearing aids 100A and 100B are significantly different each other and the case where the sound of falling out or the impact caused by falling out occur; and determining the cases as misplaced cases when a certain period of time has elapsed after detecting the cases.

Further, the hearing aid 100 may include an operation mode displaying unit, such as an LED lamp, which notifies the user of the switching of the operation mode. By notifying the user of the change of the operation mode via illuminating, changing the color, and blinking on and off of the LED lamp, the user can easily recognize the switched state. Since the remote control may be equipped with a displaying apparatus such as a liquid crystal display (LCD), a similar effect may be obtained by displaying the current operation mode on the LCD instead of displaying on the LED lamp.

In addition, the hearing aid 100A is small, and a switch on the small hearing aid 100A can cause a difficulty in operation when switching the operation mode on the hearing aid 100A at the user and on the remote control. Hence, in order to cope with cases where the hearing aid 100A is operated by a person having an affected hand, or where operating via hand is difficult due to cold protection which the user is wearing, the hearing aid 100A or the remote control may be equipped with the microphone 110 for picking up a sound and a sound recognition device or a sound detecting device in order to switch the operation mode, using sound activation via sound recognition and detection.

When using the sound activation, standards of judgment with regard to the sound recognition and detection may be cases where a recognized speech includes a predetermined keyword, and where a feature of the user's sound is analyzed out of an inputted speech and a feeling or a state of the user's mind is detected, so that states under which the user is, such as the user is nervous or worried, can be detected. The standards of judgment, indicating the states under which the user is nervous or worried, can be realized by applying a typical sound recognition technique. The sound recognition technique involves previously storing a feature parameter inside, and causing the hearing aid 100A to determine the states when the result of the feature analysis of the sound for a predetermined time period shows that the feature analysis matches with the feature parameter.

It is noted that the small hearing aid 100 may not employ the sound recognition since the recognition rate of the sound recognition cannot be 100%, or a large circuit or a large capacity of the built-in program is required to achieve the 100%-recognition rate. In other words, recognition errors possibly occur to some degree. Thus, when switching the operation mode via the sound, the user is required to check whether or not the user can switch the current operation mode to another operation mode after receiving the input of the sound.

A predetermined key-phrase is assumed as "Start the searching mode". When the user say, "Start the searching mode", the hearing aid 100 replies for checking in a sound, such as a synthetic speech, or a beep sound corresponding to the sound or the synthetic speech, such as "Ready for the search mode?", and monitors the user's sound to be inputted. Then, the user grants his or her agreement, such as a predetermined speech "Yes" and a sound typically regarded as an agreement. Hence, the hearing aid 100 switches the mode when recognizing the key-phrase indicating the agreement. This prevents the hearing aid 100B from generating abnormal noise and an altering level of the sound due to switching the mode caused by false recognition of the key-phrase.

Further, with the hearing aid 100A at the user and the remote control, the user can check the switch of the operation mode via a visual contact, a sound or light when the hearing aid 100A performs the switch of the operation mode. The user, however, cannot usually check the switch of the operation mode on the misplaced hearing aid 100B, or manually switch an operation mode of the hearing aid 100B. Thus, when the operation mode hearing aid 100A left at the user or the remote control is switched to the "non-hearing mode", the misplaced hearing aid 100B may be informed of the switching of the mode by the wireless communicating unit 130 (transmitting the instruction for outputting a searching sound, for example), and the informing of the mode switching may switch the operation mode of the lost hearing aid 100B to the "non-hearing mode".

In addition, when the hearing aid 100A left at the user is switched to the "non-hearing mode", the wireless communicating unit 130 may switch the mode of the remote control to the "non-hearing mode", as well. Displaying the operation mode on the remote control makes it easy for the user to check the switch of the operation mode. A similar effect is obtained by switching both of the operation modes on the pair of binaural hearing aids via the remote control in order to check the mode on the hearing aid 100A left at the user. As described above, switching both of the remote control and the pair of binaural hearing aids to the "non-hearing mode" makes possible locating the misplaced hearing aid 100B with a use of the remote control and the hearing aid 100A at the user, in the case where the remote control is also equipped with a microphone.

Even though the operation modes of both of the hearing aids 100A and 100B are switched to the "non-hearing mode" when the user locates the misplaced hearing aid 100B by outputting the searching sound to the remote control, the searching sound outputted via the remote control is given from both of the hearing aids 100A and 100B in the case where the misplaced hearing aid 100B cannot be recognized. The searching sound can be loud, and this is possibly an annoying sound for the user wearing the hearing aid 100A in the ear. In order to prevent the above, a switch is provided on either the hearing aid 100A or 100B in order to select to which the searching sound is transmitted when outputting the searching sound via the remote control. Hence, when the user presses the switch, a notifying sound is given to the degree that the user wearing the hearing aid 100A can hear the notifying sound. The LED lamp may be turned on, blinked, changed in color, or the hearing aid 100A may be vibrated, so that the arrival of searching sound is previously notified.

Moreover, the wireless communication may be held via Bluetooth among the remote control, the hearing aids 100A, and 100B, so that the search may be conducted within a reach of radio transmission. The pair of binaural hearing aids is required to hold communication between the hearing aids to synchronize when performing signal processing for noise reduction and speech enhancement, or adjusting time difference of the sound outputted from the earphone due to the processing time difference between the hearing aids on the right and the left. Using a communication technique employed for binaural communication and holding speech communication in the "non-hearing mode" eliminates the need for attaching an extra transmitter receiver to the hearing aids 100A and 100B, which makes possible downsizing in designing the hearing aid 100A and 100B.

Further, the wireless communicating units in the hearing aids 100A and 100B may use a different communication mode when operating in the "hearing mode" and in the "non-hearing mode". Specifically, the hearing aids 100A and 100B hold communication in a first communicating mode when both operating in the "hearing mode". Meanwhile, the hearing aids 100A and 100B hold communication in a second communicating mode when one of the hearing aids 100A and 100B is operating in the "searching mode", and the other operating in the "searched mode".

Here, the second communicating mode is wider and larger than the first communicating mode in communication area and electrical power consumption. For example, the first and the second communicating modes may employ electromagnetic induction and the Bluetooth, respectively. Further, either one of the communication modes may employ infrared.

Moreover, the same communicating technique may be used for the first and the second communicating modes each having a different output level. For example, in both of the first and the second communicating modes, the Bluetooth may be used, and the second communicating mode may be higher than the first communicating mode in output level. This makes possible selecting any given range of communication in the 30 centimeters to several tens of meters range.

According to the above structure, when the user wears the hearing aids 100A and 100B on both of the ears for use (in the case of the "hearing mode"), the hearing aid 100A and 100B can be continuously used for long hours since holding communication in a communication mode having a narrow communication range and consuming a little electricity. Meanwhile, when the user searches for the misplaced hearing aid 100B, the hearing aids 100A and 100B hold communication in a communication mode having a wide communication range and consuming a lot of electricity. Thus, the user can specify the misplacing location even though distancing himself or herself from the hearing aid 100B to some degree.

In addition, the hearing aid 100 may operate in a regular mode and a power-saving mode. In the regular mode, all the functions are under operation (electricity is supplied to all the functional blocks). In the power-saving mode, some of the functions including the operation switching unit 120 and the wireless communicating unit 130 are under operation (electricity is supplied to only some of the functional blocks). The reception of the instruction for outputting a searching sound may trigger the hearing aid 100 to switch from the power-saving mode to the regular mode.

According to the above, the hearing aid 100 stands by in the power-saving mode until the user realizes that he or she has misplaced the hearing aid 100B, and moves to the regular mode upon starting the search (in other words, transmitting the instruction for outputting a searching sound). This improves probability of finding the hearing aid 100B even though a long time has passed since the user misplaced the hearing aid 100B.

When a wide range of search is required, such as the case of misplacing the hearing aid 100B at a travel destination, a wider range of search may be conducted with a use of network communications via an access point nearby. Recently, the increasing number of wireless LAN-available hot spots is found at a café and a hotel. By using the lines to conduct communication between the hearing aids and between the hearing aid and the remote control for the hearing aid, the user can search for the misplaced hearing aid 100B at home.

Embodiment 2

Figure 3A:
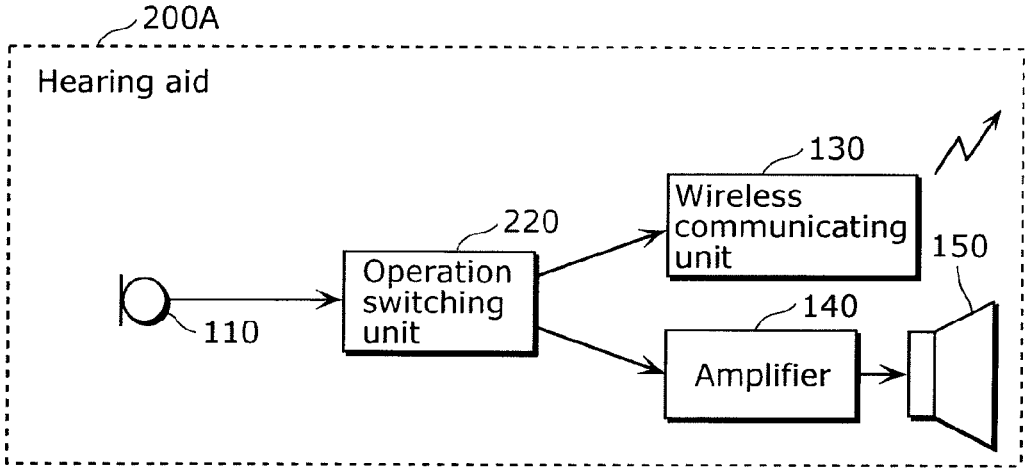
FIG. 3A shows a data flow when a hearing aid in accordance with an embodiment 2 operates in a "hearing mode" and in a "searching mode".
Figure 3B:
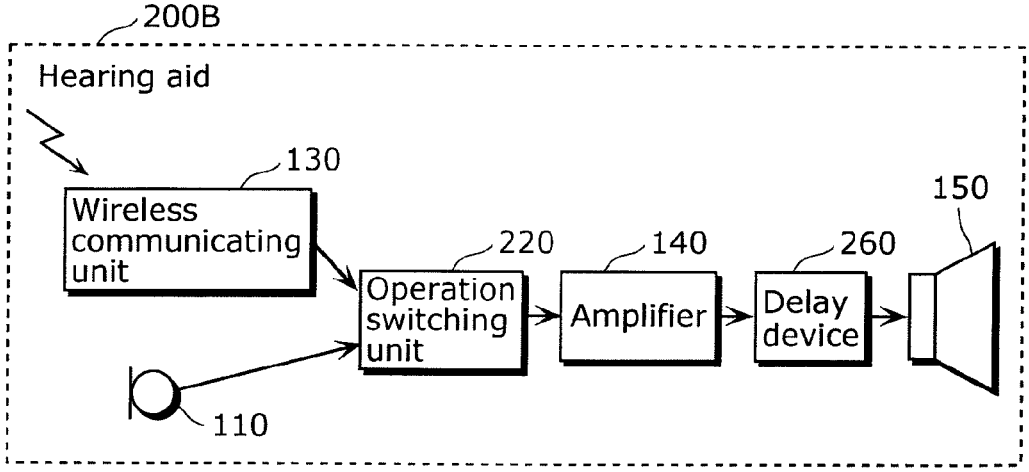
FIG. 3B shows a data flow when the hearing aid in accordance with the embodiment 2 operates in the "hearing mode" and in a "searched mode".

Described next are hearing aids 200A and 200B in accordance with an embodiment 2 of the present invention, with reference to FIGS. 3A and 3B. It is noted that FIG. 3A is a block diagram showing a data flow of the hearing aid 200A operating in the "hearing mode" and the "searching mode". FIG. 3B is a block diagram showing a data flow of the hearing aid 200B operating in the "hearing mode" and the "searched mode". Further, a structural element shared with that in the embodiment 1 has an identical numerical reference, and thus the detailed description thereof shall be omitted.

The hearing aid 200B in accordance with the embodiment 2 additionally includes a delay device (providing delay unit) 260 between the amplifier 140 and the earphone 150. The delay device temporality keeps the sound outputted from the amplifier 140 to delay the sound for a predetermined delay time, and provides the delayed sound to the earphone 150.

An operation switching unit 220 controls an operation of the delay device 260, in addition to controlling the operation of the operation switching unit 120.Specifically, the operation switching unit 220 operates the delay device 260 only in the case where the operation mode of the hearing aid 200B is the "searched mode". It is noted that the hearing aid 200A shown in FIG. 3A has a delay device (not shown) between the amplifier 140 and the earphone 150; however, the delay device 260 does not have to operate in the "hearing mode" and the "searching mode", and thus illustration thereof shall be omitted.

The embodiment 1 possibly causes difficulty in making the distinction between a speaking sound and a hearing sound because the searching sound received by the microphone 110 in the hearing aid 100A overlaps with the searching sound outputted from the earphone 150 in the hearing aid 100B. In the embodiment 2, the delay device 260 is added to delay for a predetermined delay time an outputting timing of the searching sound outputted from the earphone 150 in the hearing aid 200B.

It is noted in the above description that the delay device 260 is placed between the amplifier 140 and the earphone 150 in the hearing aid 200B, and the delay device 260 operates only in the "searched mode". Meanwhile, a structure to delay an outputting timing of the searching sound is not limited to the above structure. For example, a delay device is placed between the operation switching unit 120 and the wireless communicating unit 130 in the hearing aid 200A. Then, the searching sound picked up by the microphone 110 may be delayed by the delay device and transmitted by the wireless communicating unit 130 when the hearing aid 200A operates in the "searching mode".

Regarding the delay time, in the case where the gap is too small between the searching sound uttered to the microphone 110 in the hearing aid 200A and the searching sound outputted from the earphone 150 in the hearing aid 200B, the user cannot distinguish the latter searching sound from the former searching sound since the user hears a mixture of the uttered searching sound and the outputting searching sound. A continuing length of a vowel sound; that is possibly a minimum lasting time period of one syllabic sound, lasts approximately 0.2 seconds. Thus the delay time is desirably as long as 0.2 seconds or longer. Meanwhile, too long a delay time causes the user to misunderstand that the hearing aid 200B might not be located. Thus, the delay time may be between 0.2 seconds and five seconds.

Similar to the embodiment 1, the remote control for the pair of binaural hearing aids may employ a function to change the delay time to set a comfortable delay time, so that the user can change the delay time as needed.

When the user has misplaced both of the hearing aids 200A and 200B, the user may use the remote control including a microphone and a wireless communicating unit to search for the hearing aids 200A and 200B. When both of the hearing aids 200A and 200B simultaneously output the searching sound, however, the user finds it difficult to locate each of the hearing aids since specifying two locations at a time is difficult. Thus, the user may set a different delay time set via the remote control for each of delay devices 260 in the two hearing aids 200A and 200B. In other words, a time difference between the searching sounds outputted from the earphones 150 in the two hearing aids 200A and 200B makes it easier for the user to specify each location of the hearing aids 200A and 200B.

Embodiment 3

Figure 4A:
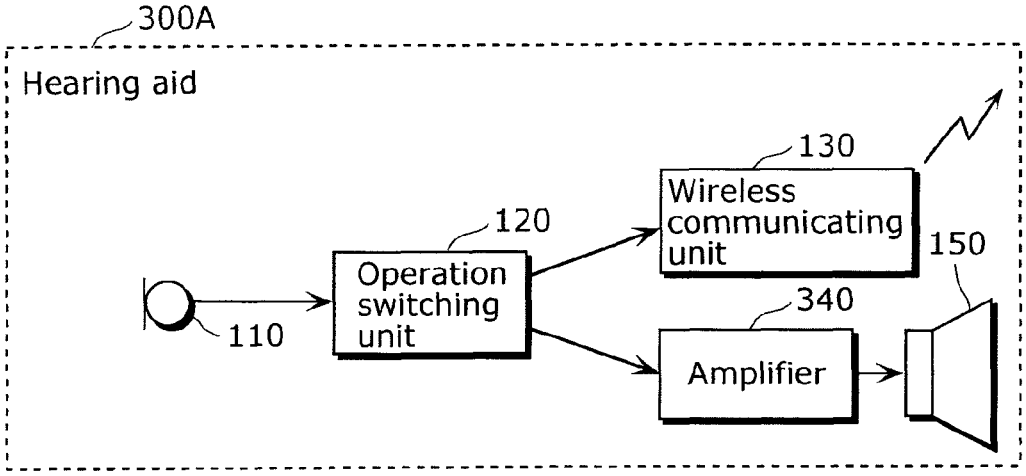
FIG. 4A shows a data flow when a hearing aid in accordance with an embodiment 3 operates in a "hearing mode" and in a "searching mode".
Figure 4B:
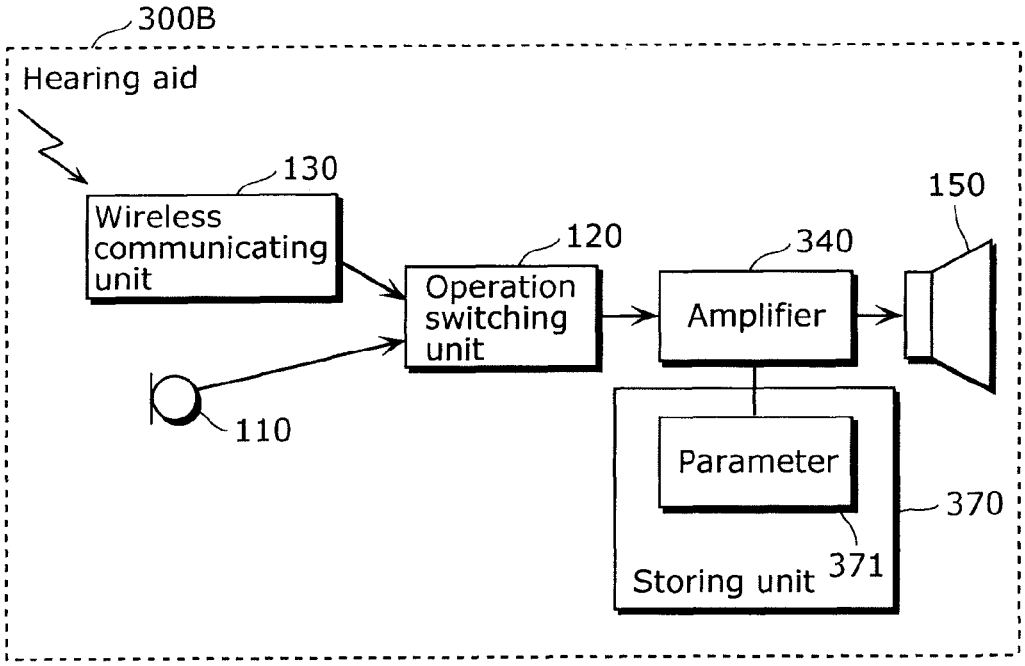
FIG. 4B shows a data flow when the hearing aid in accordance with the embodiment 3 operates in the "hearing mode" and in a "searched mode".
Figure 5A:
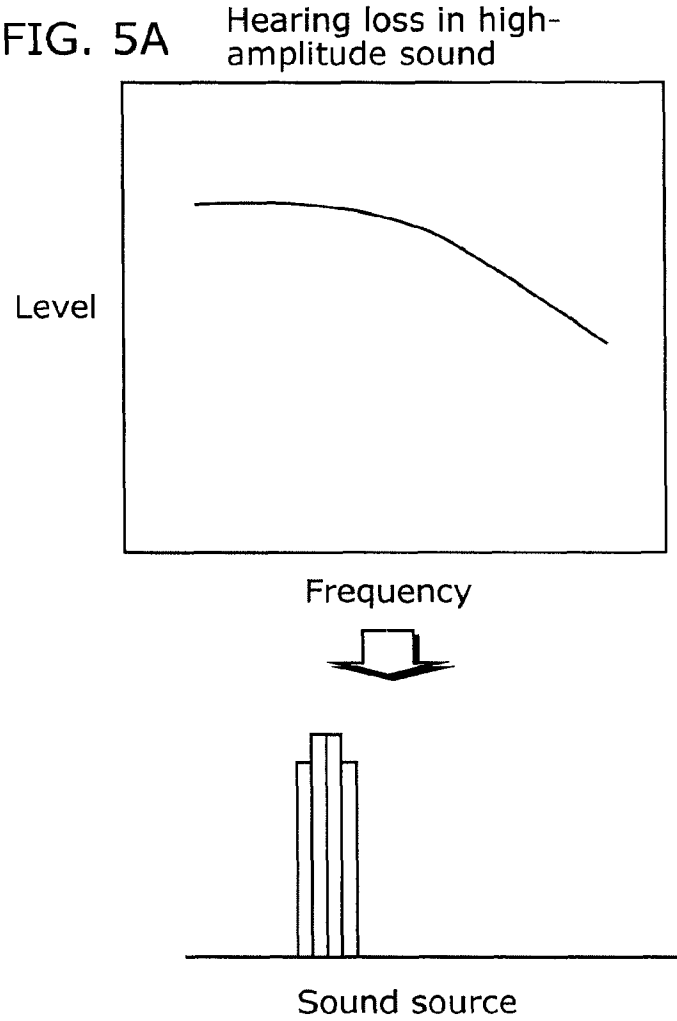
FIG. 5A shows an auditory characteristic of a user suffering from a hearing loss gradually developing in a high-amplitude sound, and a filter characteristic which copes with the auditory characteristic.
Figure 5B:
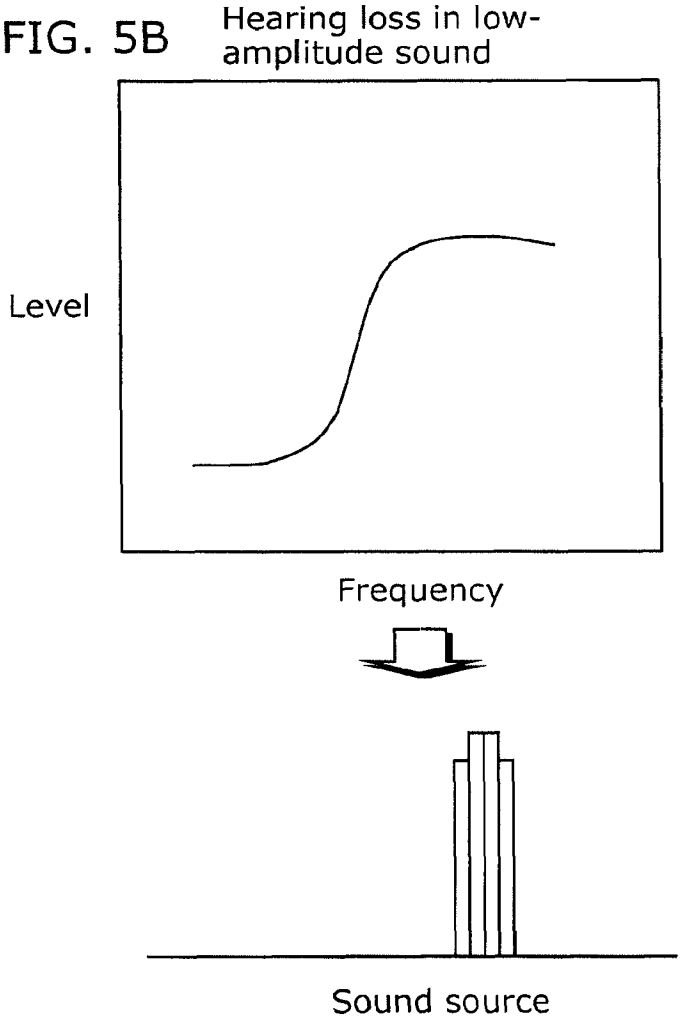
FIG. 5B shows an auditory characteristic of a user suffering from a hearing loss in a low-amplitude sound, and a filter characteristic which copes with the auditory characteristic.

Described next are hearing aids 300A and 300B in accordance with an embodiment 3 of the present invention, with reference to FIGS. 4A, 4B, 5A and 5B. It is noted that FIG. 4A is a block diagram showing a data flow of the hearing aid 300A operating in the "hearing mode" and the "searching mode". FIG. 4B is a block diagram showing a data flow of the hearing aid 300B operating in the "hearing mode" and the "searched mode". FIGS. 5A and 5B exemplify auditory characteristics of a hearing-impaired person. Here, a structural element shared with those in the embodiments 1 and 2 has an identical numerical reference, and thus detailed description shall be omitted.

The hearing aid 300B in the embodiment 3 additionally includes a recording unit 370 which records a parameter 371 per user.

The storing unit 370 includes, for example, a nonvolatile memory. The parameter 371 includes information on frequency bands suitable for remaining hearing of the user (in other words, frequency bands which the user can easily hear).

Then, when the hearing aid 300B operates in the "searched mode", an amplifying unit 340 uses the second amplification factor to selectively amplify only a frequency band, indicated in the parameter 371, out of the searching sound. Specifically, the amplifying unit 340 sequentially performs (i) filtering processing for extracting only the frequency band, indicated in the parameter 371, out of the searching sound, and (ii) amplifying processing for amplifying the extracted component. It is noted that a use of a Band Pass Filter (BPF) achieves the filtering processing.

Exemplified herewith is a setting of the parameter 371, with reference to FIGS. 5A and 5B. FIG. 5A illustrates an auditory characteristic of a hearing loss gradually developing in a high-amplitude sound (top half), showing a deteriorating hearing ability in high frequency. Here, the filter characteristic for the parameter 371 is set to emphasize a sound in a low-middle frequency having a relatively high sensitivity (bottom half). On the contrary, FIG. 5B illustrates an auditory characteristic of a hearing loss in a low-amplitude sound (top half), showing a deteriorating hearing ability in low frequency. Here, the filter characteristic for the parameter 371 is set to emphasize a sound in a middle-high frequency having a relatively high sensitivity (bottom half).Since the user can hear a sound with a band having an excellent hearing sensitivity, overhearing the searching sound can be prevented.

When the user produces the searching sound toward the microphone 110 in the hearing 300A at the user to locate the misplaced hearing aid 300B, the user faces a difficulty in hearing the searching sound outputted from the misplaced hearing aid 300B since the user is not wearing the hearing aids 300A and 300B. Hence, a signal of the searching sound outputted from the earphone 150 in the hearing aid 300B may be processed according to the remaining hearing of the user, so that the user can hear the searching sound when the user is not wearing the hearing aids 300A and 300B.

It is noted that the hearing aids 300A and 300B may process a signal of the hearing sound based on a hearing characteristic of the user and output the signal-processed hearing sound, operating in the "hearing mode" as well. The signal processing in this case, however, amplifies a band of an amplification factor, with which the user has a difficulty in hearing (high frequency in FIG. 5A and low frequency in FIG. 5B), greater than the other bands. In other words, the signal processing is completely different from the processing for selectively amplifying only the band which the user can easily hear, as described above.

Embodiment 4

Figure 6A:
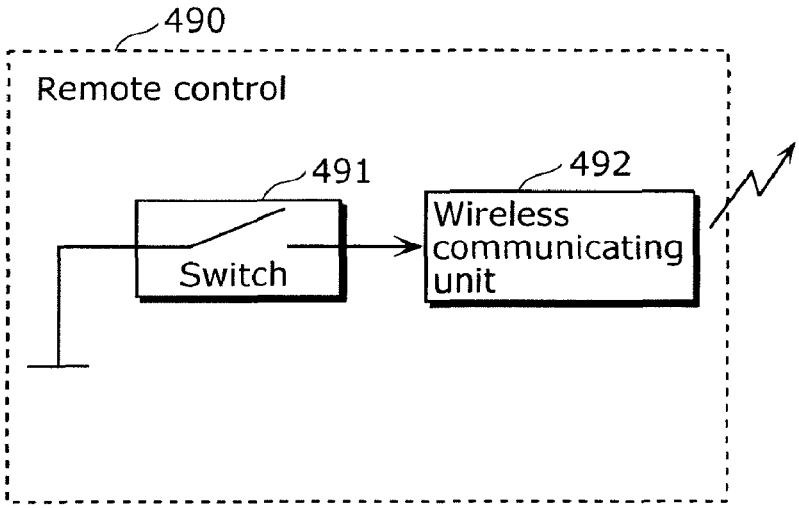
FIG. 6A is a functional block diagram of a remote control in accordance with an embodiment 4.
Figure 6B:
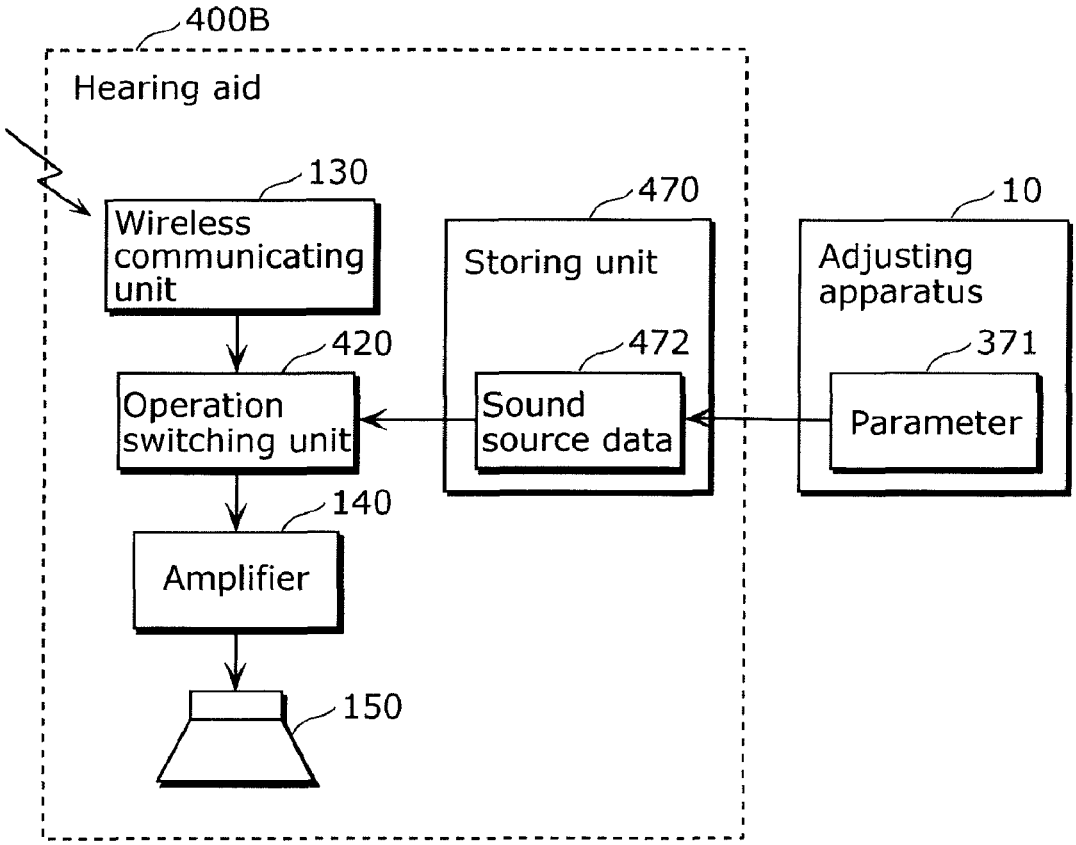
FIG. 6B shows a data flow when a hearing aid in accordance with the embodiment 4 operates in a "searched mode".

Described next are a remote control 490 and a hearing aid 400B in accordance with an embodiment 4 of the present invention, with reference to FIGS. 6A and 6B. It is noted that the FIG. 6A is a block diagram showing a structure of the remote control 490. FIG. 6B is a block diagram showing a data flow of the hearing aid 400B operating in the "searched mode". Here, a structural element shared with those in the embodiments 1 to 3 has an identical numerical reference, and thus detailed description shall be omitted.

As illustrated in FIG. 6A, the remote control 490 in accordance with the embodiment 4 includes a switch 491 and a wireless communicating unit 492. The switch 491 works as a trigger to transmit the instruction for outputting a searching sound. The wireless communicating unit 492 holds wireless communication with the hearing aid 400B. In other words, turning the switch 491 "ON" transmits the instruction for outputting a searching sound to the hearing aid 400B via the wireless communicating unit 492.

Meanwhile, the hearing aid 4008 in accordance with the embodiment 4 additionally includes a storing unit 470 for storing sound source data 472 which is to be the searching sound. It is noted that the sound source data 472, which is previously created, is stored in the storing unit 470 by an adjusting apparatus (an external apparatus) 10. Then, in response to the reception of the instruction for outputting a searching sound at the wireless communicating unit 130, an operation switching unit 420 reads the sound source data 472 from the storing unit 470, causes the amplifier 140 to amplify the sound source data 472 as the searching sound with a use of the second amplification factor, and outputs the searching sound from the earphone 150.

It is noted that the sound source data 472 is created out of pieces of sound source data by (i) selecting a sound having a frequency suitable for the remaining hearing of the user, (ii) shifting a frequency of a piece of sound source data, so that the frequency suits the remaining hearing, (iii) outputting filtering for adjusting hearing for each band, and (iv) adjusting a piece of sound source data to be audible volume. Moreover, the sound source data 472 may receive, to be set on the hearing aid 400B, filtering in order to emphasize a band with little degradation of a hearing characteristic of the user, as performed in the embodiment 3.

Here, a personal computer may be used for fitting the sound source data 472 to plot on the monitor hearing data of the user (the result shown by an audiometer) and a frequency characteristic of the selected or adjusted sound source data 472, so that the sound source data 472 may be checked whether or not the sound source data 472 itself is suitable for the hearing of the user. For the user, the visualized sound source data 472, showing whether or not the sound source data 472 suits the hearing of the user himself or herself, sets a guideline for creating the sound source data 472 in the case where the user himself or herself adjusts the sound source data 472.

Further, the user can connect the hearing aid 400B with an adjustment terminal on the personal computer in order to make the sound source data 472 readily changeable, so that the user can easily cope with the case where the user wants to change the searching sound.

The user faces a difficulty in telling a direction of the sound source when a single frequency, such as a sine curve, is used for the sound source data 472. The user tells the direction by judging the direction based on a phase contrast and an amplitude difference of sounds entering both of the ears. Fewer frequency components mean fewer components for detecting the phase contrast and the amplitude difference for telling the direction. Thus, the sound source data 472 may be created with a use of a sound having a band as high as one third octave-bands or higher, which is required for telling the direction.

In addition, the user may use a hearing aid at the user (not shown) to transmit the instruction for outputting a searching sound, instead of using the remote control 490, in the case where one of the pair of binaural hearing aids is at the user.

As the structure described above, creating the sound source data 472 based on the hearing data of the user can output a searching sound which the user can readily hear. This makes possible locating the hearing aid 400B more easily.

Embodiment 5

Figure 7A:
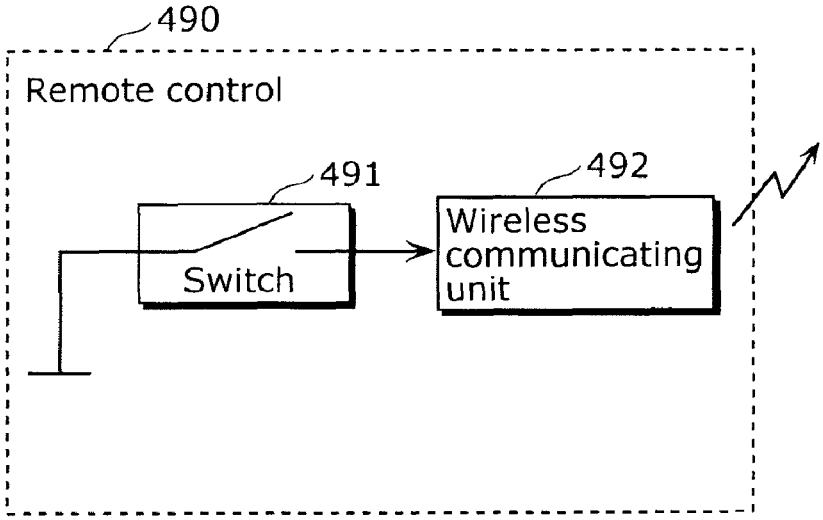
FIG. 7A is a functional block diagram of a remote control in accordance with an embodiment 5.
Figure 7B:
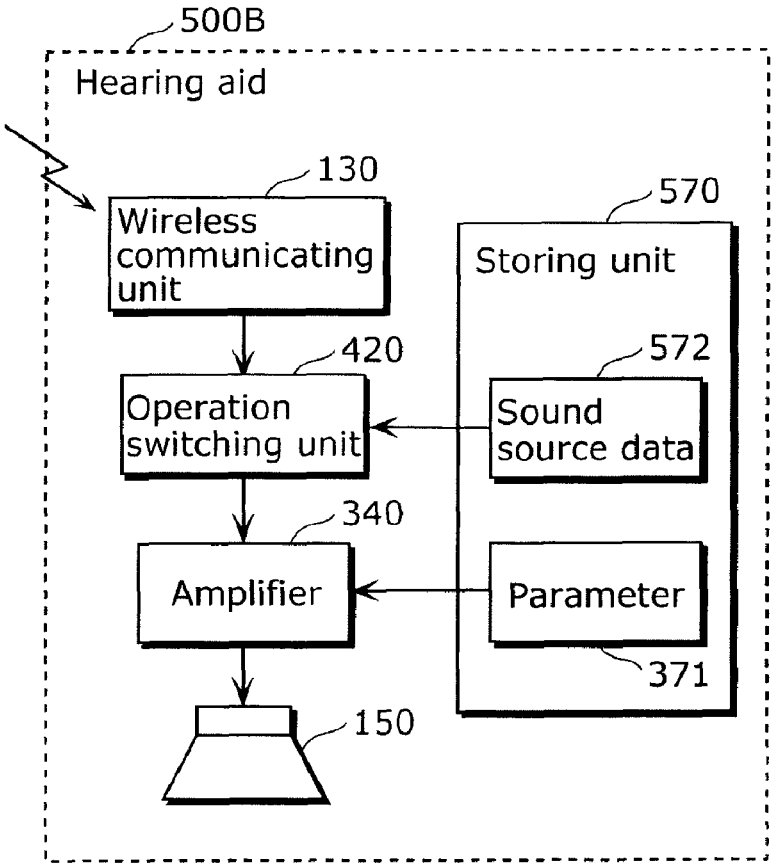
FIG. 7B shows a data flow when a hearing aid in accordance with the embodiment 5 operates in a "searched mode".

Described next are a remote control 490 and a hearing aid 500B in accordance with an embodiment 5 of the present invention, with reference to FIGS. 7A and 7B. It is noted that the FIG. 7A is a block diagram showing a structure of the remote control 490. FIG. 7B is a block diagram showing a data flow of the hearing aid 500B operating in the "searched mode". Here, a structural element shared with those in the embodiments 1 to 4 has an identical numerical reference, and thus detailed description shall be omitted.

The hearing aid 500B in accordance with the embodiment 5 additionally includes a storing unit 570 which stores the parameter 371 and sound source data 572. It is noted that a signal of the sound source data 572, which is different from that of the sound source 572 in the embodiment 4, is assumed to receive no processing based on the a hearing characteristic of the user.

In response to the reception of the instruction for providing a searching sound from the remote control 490, the operation switching unit 420 reads the sound source data 572 from the storing unit 570, causes an amplifier 340 to amplify the sound source data 472 as the searching sound with a use of the second amplification factor, and provides the searching sound from the earphone 150. Further, the amplifier 340 selectively amplifies only the frequency band, indicated by the parameter 371, out of the sound source data 572 obtained from the operation switching unit 420 with a use of the second amplification factor.

The above structure makes possible obtaining a similar effect as the embodiment 4 obtains. The difference from the embodiment 4 is that the sound source data 572 can be stored before shipment since the sound source data 572 does not have to be previously processed based on a hearing characteristic of the user. Meanwhile, the embodiment 4 is more advantageous than the embodiment 5 in that the embodiment 4 eliminates the need for filtering in outputting the searching sound.

It is noted that any given combination of the above embodiments 1 to 5 is available to the degree that the combination does not hinder the effects of the present invention.

In order to realize the hearing aid in accordance with the embodiments 1 to 5, each of functional blocks described above may be a program in software and a medium on which the program is recorded. As a matter of course, such a program can be distributed via a recording medium including a CD-ROM and a transmission medium including the Internet.

Each of the functional blocks included in the hearing aid in accordance with the embodiments 1 to 5 is typically realized in a form of a program operating on an information device which requires a CPU (Central Processing Unit) and a memory. Meanwhile, some or all of the functions of the functional blocks may be realized in a form of an integrated circuit; namely, an LSI (Large Scale Integration).Each LSI may include one of the functions, or some or all of the functions. Referred herewith is an LSI; meanwhile, an LSI may also be called as an IC (Integrated Circuit), a system LSI, a super LSI, and an ultra LSI, depending on a difference of an integration degree.

A technique for realizing the functions in a form of an integrated circuit shall not be limited to an LSI. The functions may be realized in a form of a dedicated circuit or a general purpose processor. Possibly used are: an FPGA (Field Programmable Gate Array) in order to formulate a program after building an LSI; and a reconfigurable processor so that a connection and setting of a circuit cell in the LSI is reconfigurable.

Further, a new technology for realizing the functions in a form of an integrated circuit may appear due to development of a semiconductor technology and an another technology derived from the development, and replace the LSI. As a matter course, the new technology may be utilized to integrate the functional blocks. A biotechnology is possibly applicable.

Described above are the embodiments of the present invention, with reference to the drawings. The present invention, however, shall not be limited to the embodiments illustrated in the drawings. Many modifications are possible in the embodiments illustrated in the drawings without materially departing from the novel teachings and advantages of this invention, and therefore, all such modifications are intended to be included within the scope of this invention.

Industrial Applicability

A hearing aid in accordance with the present invention is useful since the hearing aid is easily located when misplaced.

Reference Signs List

10 Adjusting apparatus
100, 100A, 100B, 200A, 200B, 300A, 300B, 400B, 500B Hearing aid
110 Microphone
120, 220, 420 Operation switching unit
130, 492 Wireless communicating unit
140, 340 Amplifier
150 Earphone
260 Delay device
370, 470, 570 Storing unit
371 Parameter
472, 572 Sound source data
490 Remote control

The invention claimed is:

1. A hearing aid which fits in an ear of a user, amplifies a sound and outputs the amplified sound, said hearing aid comprising:

a pick-up unit configured to pick up the sound;

a wireless communicating unit configured to receive, from a wirelessly connected external apparatus, an instruction for outputting a searching sound;

an amplifying unit configured to amplify the sound;

an outputting unit configured to output the sound amplified by said amplifying unit;

an operation switching unit configured to switch between a hearing mode and a searched mode, the hearing mode causing said amplifying unit to amplify a hearing sound, which is the sound picked up by said pick-up unit, with use of a first amplification factor, and the searched mode causing said amplifying unit to amplify the searching sound, in response to the reception of the instruction for outputting the searching sound, with use of a second amplification factor greater than the first amplification factor; and a storing unit configured to store a parameter indicating a frequency band suitable for a remaining hearing capability of the user, wherein, when said operation switching unit is in the searched mode, said amplifying unit extracts the frequency band indicated by the parameter from the searching sound, and amplifies the frequency band extracted from the searching sound with use of the second amplification factor.

2. The hearing aid according to claim 1, further comprising a storage unit configured to store the searching sound, wherein said amplifying unit amplifies the searching sound read from said storage unit using the second amplification factor when said wireless communicating unit receives the instruction for outputting the searching sound.

3. The hearing aid according to claim 1, wherein said wireless communicating unit is further configured to receive, from the external apparatus, both (i) the instruction for outputting the searching sound and (ii) the searching sound, and said amplifying unit amplifies the searching sound using the second amplification factor when said wireless communicating unit receives the searching sound from the external apparatus.

4. The hearing aid according to claim 3, further comprising a providing delay unit configured, in the searched mode, to delay the searching sound for a predetermined delay time, and to provide the delayed searching sound to said outputting unit, the searching sound being amplified by said amplifying unit using the second amplification factor.

5. The hearing aid according to claim 4, wherein the predetermined delay time is between 0.2 seconds and 5 seconds.

6. The hearing aid according to claim 3, wherein said operation switching unit is further configured to switch to a searching mode causing said wireless communicating unit to transmit the instruction for outputting the searching sound to another hearing aid.

7. The hearing aid according to claim 6, wherein, in the searching mode, said operation switching unit causes said wireless communicating unit to transmit, as the searching sound, the sound picked up by said pick-up unit to the other hearing aid.

8. A hearing aid apparatus comprising:

a first hearing aid which fits in an ear of a user and is the hearing aid according to claim 1; and a second hearing aid which fits in another ear of the user and is the hearing aid according to claim 1.

9. The hearing aid apparatus according to claim 8, wherein said wireless communicating unit of each of said first hearing aid and said second hearing aid is configured to:

mutually hold wireless communication using a first communicating mode in a case where both of said first hearing aid and said second hearing aid are in the hearing mode; and mutually hold wireless communication using a second communicating mode in a case where said first hearing aid and said second hearing aid are in the searched mode, the second communicating mode having a wider communication area than the first communicating mode.

10. The hearing aid apparatus according to claim 8, further comprising a remote control which wirelessly transmits the instruction for outputting the searching sound to at least one of said first hearing aid and said second hearing aid.

11. A hearing aid method for amplifying a sound and outputting the amplified sound, using a hearing aid fitting in an ear of a user, said hearing aid method comprising:

picking up the sound;

receiving, from a wirelessly connected external apparatus, an instruction for outputting a searching sound;

amplifying the sound;

outputting the sound amplified in said amplifying; and in said amplifying, switching between a hearing mode and a searched mode, the hearing mode involving amplifying a hearing sound, which is the sound picked up in said picking up, with use of a first amplification factor, and the searched mode involving amplifying the searching sound, in response to the reception of the instruction for outputting the searching sound, with use of a second amplification factor greater than the first amplification factor, wherein, when said amplifying is in the searched mode, said amplifying extracts a frequency band suitable for a remaining hearing capability of the user from the searching sound and amplifies the frequency band extracted from the searching sound with use of the second amplification factor.

12. An integrated circuit which amplifies a sound and outputs the amplified sound, said integrated circuit comprising:

a pick-up unit configured to pick up the sound;

a wireless communicating unit configured to receive, from a wirelessly connected external apparatus, an instruction for outputting a searching sound;

an amplifying unit configured to amplify the sound;

an outputting unit configured to output the sound amplified by said amplifying unit; and an operation switching unit configured to switch between a hearing mode and a searched mode, the hearing mode causing said amplifying unit to amplify a hearing sound, which is the sound picked up by said pick-up unit, with use of a first amplification factor, and the searched mode causing said amplifying unit to amplify the searching sound, in response to the reception of the instruction for outputting the searching sound, with use of a second amplification factor greater than the first amplification factor, wherein, when said operation switching unit is in the searched mode, said amplifying unit extracts a frequency band suitable for a remaining hearing capability of a user from the searching sound, and amplifies the frequency band extracted from the searching sound with use of the second amplification factor.

* * * * *